US009377235B2

(12) United States Patent
Kim et al.

(10) Patent No.: US 9,377,235 B2
(45) Date of Patent: Jun. 28, 2016

(54) REFRIGERATOR AND CONTROL METHOD FOR THE SAME

(75) Inventors: Do Hyung Kim, Yongin-si (KR); Jin Jeong, Yongin-si (KR); Sang Hyun Park, Seongnam-si (KR); Yong Sung Yoon, Ansan-si (KR); Khanqasim, Suwon-si (KR); Seung Ah Joo, Goyang-si (KR)

(73) Assignee: SAMSUNG ELECTRONICS CO., LTD., Suwon-Si (KR)

( * ) Notice: Subject to any disclaimer, the term of this patent is extended or adjusted under 35 U.S.C. 154(b) by 1007 days.

(21) Appl. No.: 13/413,212

(22) Filed: Mar. 6, 2012

(65) Prior Publication Data

US 2012/0227421 A1 Sep. 13, 2012

(30) Foreign Application Priority Data

Mar. 10, 2011 (KR) ..... 10-2011-0021419

(51) Int. Cl.
*F25C 1/00* (2006.01)
*F25C 5/18* (2006.01)

(52) U.S. Cl.
CPC ..... *F25C 5/187* (2013.01)

(58) Field of Classification Search
CPC ..... F25C 5/187; F25C 5/002; F25C 5/18; F25C 2400/00
USPC ..... 62/66, 71, 349, 351, 352, 459, 464
See application file for complete search history.

(56) References Cited

U.S. PATENT DOCUMENTS 2,449,132 A * 9/1948 Lucia ..... F25C 1/12 241/101.5
6,442,954 B1 * 9/2002 Shapiro ..... F25C 5/005 62/137
7,065,975 B1 * 6/2006 Herndon ..... F25C 5/005 62/344
2001/0027654 A1 10/2001 Shapiro et al.
2006/0059939 A1 * 3/2006 An ..... F25C 5/046 62/344
2008/0272679 A1 * 11/2008 Wuesthoff ..... F25C 5/005 312/404
2010/0037631 A1 * 2/2010 Choi ..... F25C 5/005 62/66
2010/0050680 A1 * 3/2010 Venkatakrishnan et al. .... 62/340

(Continued)

FOREIGN PATENT DOCUMENTS

KR 10-2010-0027955 3/2010

OTHER PUBLICATIONS

Espacenet English Abstract of Korean Publication No. 10-2010-0027955, Published Mar. 11, 2010.

(Continued)

*Primary Examiner* — Emmanuel Duke
(74) *Attorney, Agent, or Firm* — Staas & Halsey LLP

(57) ABSTRACT

A refrigerator including a main body provided with a refrigerating chamber at an upper section and with a freezing chamber at a lower section, an ice making tray disposed in an upper space of an ice making chamber defined in the refrigerating chamber, a first storage container disposed in a lower space of the ice making chamber to store ice falling down from the ice making tray, and a second storage container disposed in a freezing chamber to store ice transferred from the ice making tray. The main body includes a guide channel to guide, when the first storage container reaches an ice-full state, ice falling from the ice making tray to the second storage container in the freezing chamber. The size of the ice making chamber is greatly reduced while a sufficient amount of the ice may be stored, thus securing a larger available space in the refrigerating chamber.

11 Claims, 7 Drawing Sheets

(56) References Cited

U.S. PATENT DOCUMENTS

2010/0050681 A1* 3/2010 Ryu ..... F25C 1/00 62/344
2011/0036115 A1* 2/2011 Lee ..... F25C 1/08 62/344

OTHER PUBLICATIONS

Korean Office Action dated Mar. 19, 2015 in corresponding Korean Patent Application No. 10-2011-0021419.

* cited by examiner

REFRIGERATOR AND CONTROL METHOD FOR THE SAME

CROSS-REFERENCE TO RELATED APPLICATIONS

This application claims the benefit of Korean Patent Application No. 2011-0021419, filed on Mar. 10, 2011 in the Korean Intellectual Property Office, the disclosure of which is incorporated herein by reference.

BACKGROUND

1. Field

Embodiments of the present invention relate to a refrigerator having an ice maker installed at a door to make water or ice and a control method for the same.

2. Description of the Related Art

A refrigerator is an apparatus which includes refrigeration cycle components therein to refrigerate or freeze foods stored therein using cool air generated from an evaporator among the refrigeration cycle components.

In a recent refrigerator, a refrigerating chamber with a relatively high use frequency is disposed at an upper section of the refrigerator while a freezing chamber is disposed at a lower section of the refrigerator. A dispenser is installed at a refrigerating chamber door to open/close the refrigerating chamber in order to dispense ice through the dispenser.

In such a refrigerator, an ice maker is also installed to make ice to be discharged through the dispenser, and the ice maker is advantageously disposed at a higher position than the dispenser in consideration of discharging the ice. Therefore, an ice making chamber is defined at one side of an upper portion of the refrigerating chamber using a thermal insulation wall, and the ice maker is installed in the ice making chamber.

SUMMARY

Therefore, it is an aspect to provide a refrigerator in which larger space of a refrigerating chamber becomes available and a method to control such a refrigerator.

Additional aspects will be set forth in part in the description which follows and, in part, will be obvious from the description, or may be learned by practice of the invention.

In accordance with one aspect, a refrigerator includes a main body comprising a refrigerating chamber at an upper section thereof and provided with a freezing chamber at a lower section thereof, an ice making tray disposed in an upper space of an ice making chamber defined in the refrigerating chamber, a first storage container in a lower space of the ice making chamber to store ice falling from the ice making tray, and a second storage container in a freezing chamber to store ice transferred from the ice making tray, and the main body includes a guide channel to guide, when the first storage container enters an ice-full state, ice falling from the ice making tray to the second storage container in the freezing chamber.

The guide channel may be formed in a recessed way into a side wall of the main body, and the refrigerator may further include a channel cover removably installed to the side wall of the main body to cover the guide channel.

The refrigerator may further include a guide member to selectively guide ice removed from the ice making tray to any one of the guide channel and the first storage container, and a driving device to rotate the guide member.

The guide member may be rotatably installed to the side wall of the main body to guide the ice to any one of the guide channel and the first storage container depending on a rotation angle thereof.

The refrigerator may further include a refrigerating chamber door to open or close the refrigerating chamber, and a dispenser disposed in the refrigerating chamber door to guide discharge of the ice.

The refrigerator may further include a conveying auger disposed in the first storage container to enable ice in the first storage container to be discharged through the dispenser.

In accordance with another aspect, provided is a method to control a refrigerator comprising a refrigerating chamber at an upper section thereof and provided with a freezing chamber at a lower section. The method includes controlling an ice making operation of an ice maker to make ice in an ice making chamber defined in the refrigerating chamber to accommodate the ice maker, and guiding the ice to a first storage container in a lower space of the ice making chamber and a second storage container in the freezing chamber such that the ice is first guided to the first storage container until the first storage enters an ice-full state, and then to the second storage container until the second storage container enters an ice-full state.

The method may include determining whether the first storage container is in an ice-full state, beginning, upon determining that the first storage container is not in an ice-full state, to make ice using the ice maker, and guiding the ice made by the ice maker to the first storage container until the first storage container reaches an ice-full state.

The method may further include upon a determination that the first storage container is in an ice-full state, determining whether the second storage container is in an ice-full state. Upon determination that the second storage container is not in an ice-full state, to make ice using the ice maker, and guiding the ice made by the ice maker to the second storage container until the second storage container reaches an ice-full state.

The method may further include, after the second storage container reaches an ice-full state, terminating production of the ice using the ice maker.

The method may further include determining whether the first storage container is in an ice-full state, on a determination that the first storage container is in an ice-full state, determining whether the second storage container is in an ice-full state. Upon determining that the second storage container is not in an ice-full state, to make ice using the ice maker, and guiding the ice made by the ice maker to the second storage container until the second storage container reaches an ice-full state.

As described above, after the first storage container disposed in the ice making chamber reaches an ice-full state, the ice is transferred through the guide channel to the second storage container provided in the freezing chamber and then is stored therein. In this way, the size of the ice making chamber may be greatly reduced while a sufficient amount of the ice may be stored, resulting in securing a larger available space in the refrigerating chamber.

BRIEF DESCRIPTION OF THE DRAWINGS

These and/or other aspects of the invention will become apparent and more readily appreciated from the following description of the embodiments, taken in conjunction with the accompanying drawings of which.

DETAILED DESCRIPTION

Figure 1:
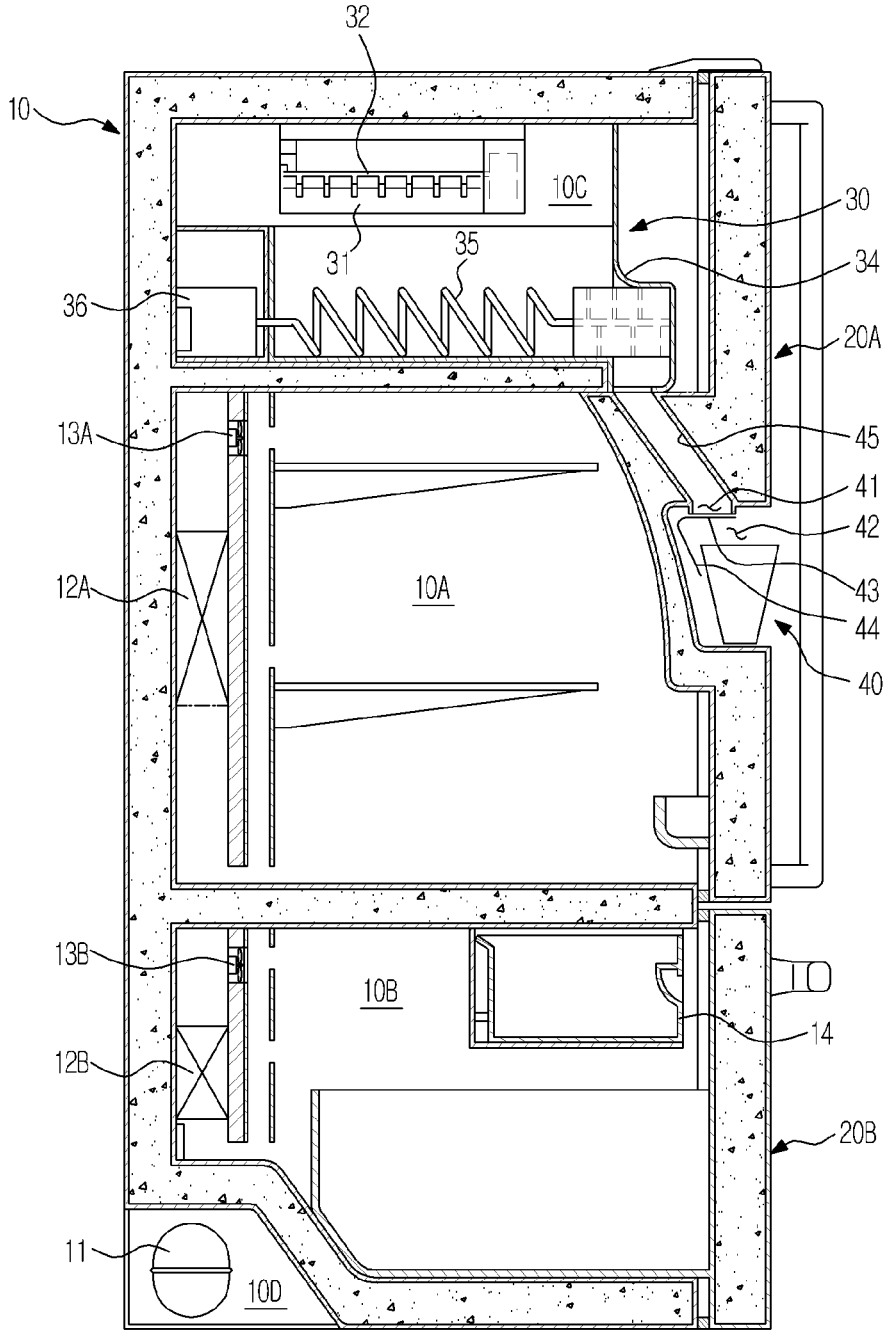
FIG. 1 is a cross-sectional view of a refrigerator according to one embodiment of the present invention.

Reference will now be made in detail to the embodiments of the present invention, examples of which are illustrated in the accompanying drawings, wherein like reference numerals refer to like elements throughout.

Below, a refrigerator according to one embodiment of the present invention will be described in detail with reference to the accompanying drawings.

Figure 2:
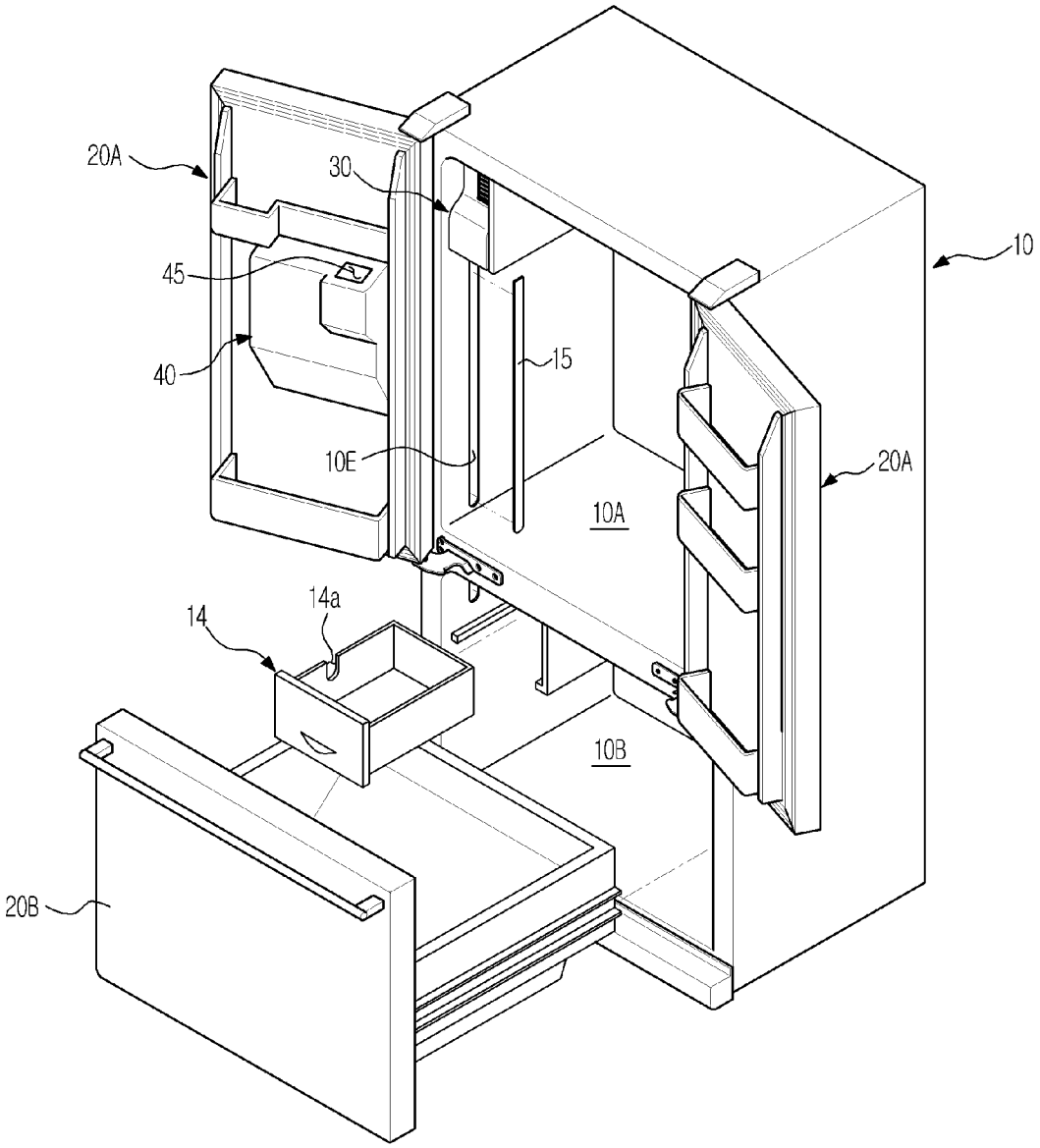
FIG. 2 is a perspective view of a refrigerator according to one embodiment of the present invention.

As shown in FIG. 1 and FIG. 2, a refrigerator according to one embodiment of the present invention includes a main body 10 which forms the appearance of the refrigerator and in which a plurality of food storage chambers, for example, two storage chambers 10A and 10B, are installed to be separated from each other. In this embodiment, the food storage chambers 10A and 10B are vertically partitioned such that the upper storage chamber 10A forms a refrigerating chamber to store food in a refrigerated state and the lower storage chamber 10B forms a freezing chamber to store food in a frozen state.

A pair of doors 20A, 20A is installed at both sides of an upper section of the main body 10 so that each of one-side ends of the doors is installed to the main body 10 in a pivotable way. In this manner, using the pair of doors 20A, 20A, the refrigerating chamber 10A can be opened or closed. In the freezing chamber 10B, a freezing chamber door 20B is installed to move between an extended position and a retracted position so that the freezing chamber 10B has a drawer type structure.

In a rear side of a lower section of the main body 10, there is a machine chamber 10D accommodating a compressor 11 to compress refrigerant, a condenser (not shown) in which the refrigerant and air exchange heat with each other and the refrigerant becomes cool, and an expansion valve (not shown) to expand the refrigerant in a pressure-reducing manner. In rear sides of the refrigerating and freezing chambers 10A and 10B, there are disposed evaporators 12A and 12B to generate cool air and two blowing fans 13A and 13B to enable the cool air generated from the evaporators to be supplied into the refrigerating and freezing chambers 10A and 10B. In this example, to cool the refrigerating and freezing chambers 10A and 10B independently, the two evaporators 12A and 12B are respectively disposed at the rear sides of the refrigerating and freezing chambers 10A and 10B.

The refrigerator includes an ice maker 30 to make ice and a dispenser 40 positioned in the refrigerating chamber door 20A to guide outward discharge of ice made by the ice maker 30. Since it is advantageous in discharging the ice that the ice maker 30 is positioned above the dispenser 40, an ice making chamber 10C is defined at one side of an upper portion of the refrigerating chamber 10A by a thermal insulation wall, and the ice maker 30 is installed in the ice making chamber 10C. Although not shown, an ice making switch is installed at the refrigerating chamber door 20A to allow users to select an ice making operation.

The ice maker 30 includes an ice making tray 31 disposed at an upper space of the ice making chamber 10C in which ice is made, a scraper 32 to separate ice from the ice making tray 31, a heater 33 (refer to FIG. 3) to allow ice in the ice making tray 31 to be removed easily from the tray, a first storage container 34 disposed at a lower space of the ice making chamber 10C to receive ice removed from the ice making tray 31 and store it, a conveying auger 35 rotatably installed in the first storage container 34 to guide, via its rotation, ice to be discharged to the dispenser 40, and a conveying motor 36 to rotate the conveying auger 35.

The dispenser 40 includes a discharge portion 42 which is a space formed by making a depression from a front face of the refrigerating chamber door 20A toward an inner side of the refrigerating chamber door 20A and which has a discharge opening 41 for discharge of ice. The dispenser 40 also includes an opening/closing member 43 to open or close the discharge opening 41, an actuating lever 44 installed in the discharge portion 42 to operate the opening/closing member 43 and at the same time operate the conveying auger. The dispenser also includes a discharging channel 45 to guide ice discharged from the first storage container 34 to the discharge opening 41.

The above-mentioned ice making chamber 10C is defined at one side of and within the refrigerating chamber 10A. Therefore, the larger the size of the ice making chamber 10C, the smaller the size of the refrigerating chamber 10A, resulting in limitation of the size of the first storage container 34 to a certain level.

For this reason, in this embodiment of the invention, a guide channel 10E is installed to guide ice removed from the ice making tray 31 to the freezing chamber 10B, and a second storage container 14 is provided in the freezing chamber 10B to receive the ice transferred along the guide channel 10E and store it.

Figure 3:
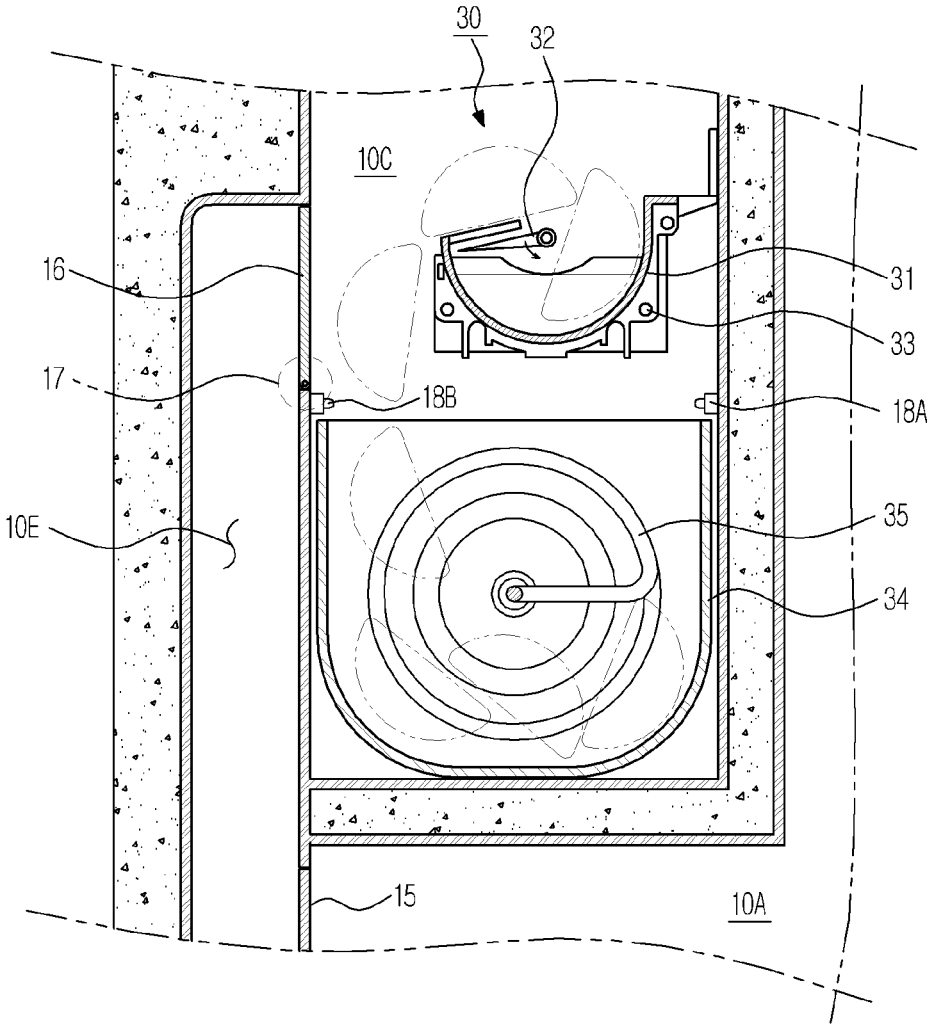
FIG. 3 and FIG. 4 are cross-sectional views in operations of an ice maker employed in a refrigerator according to one embodiment of the present invention.
Figure 4:
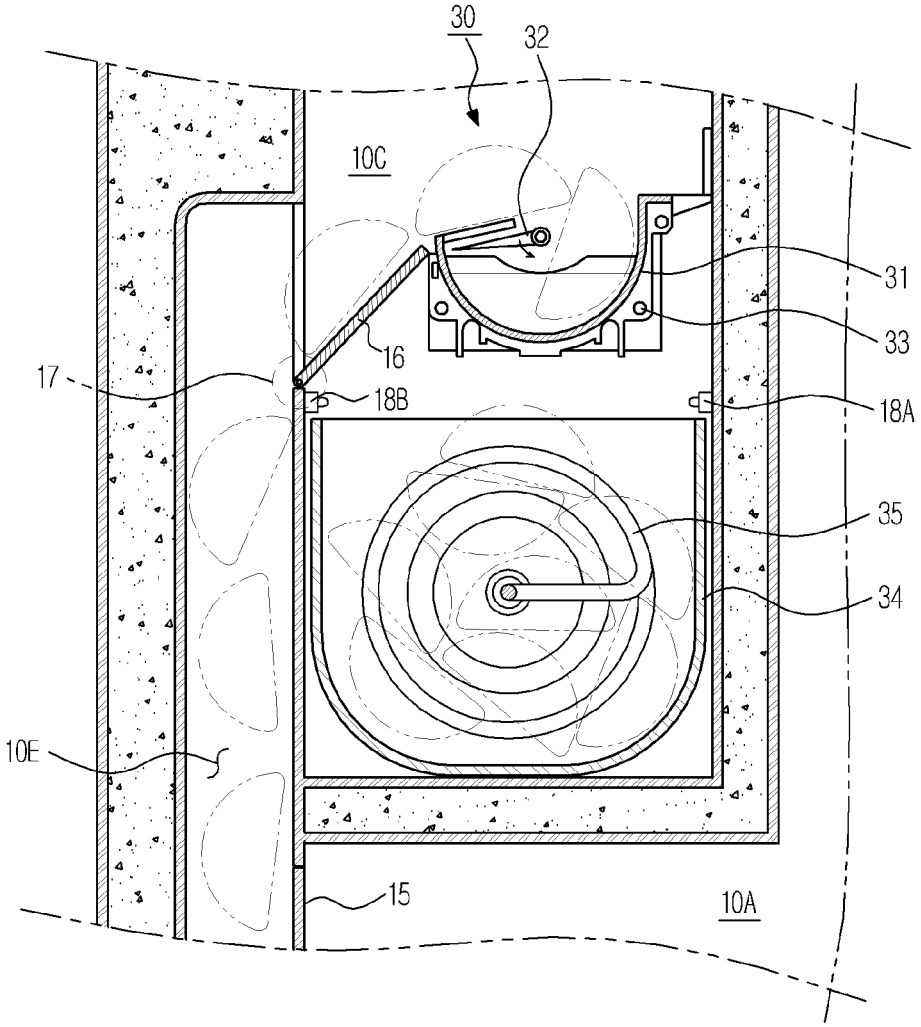
Figure 5:
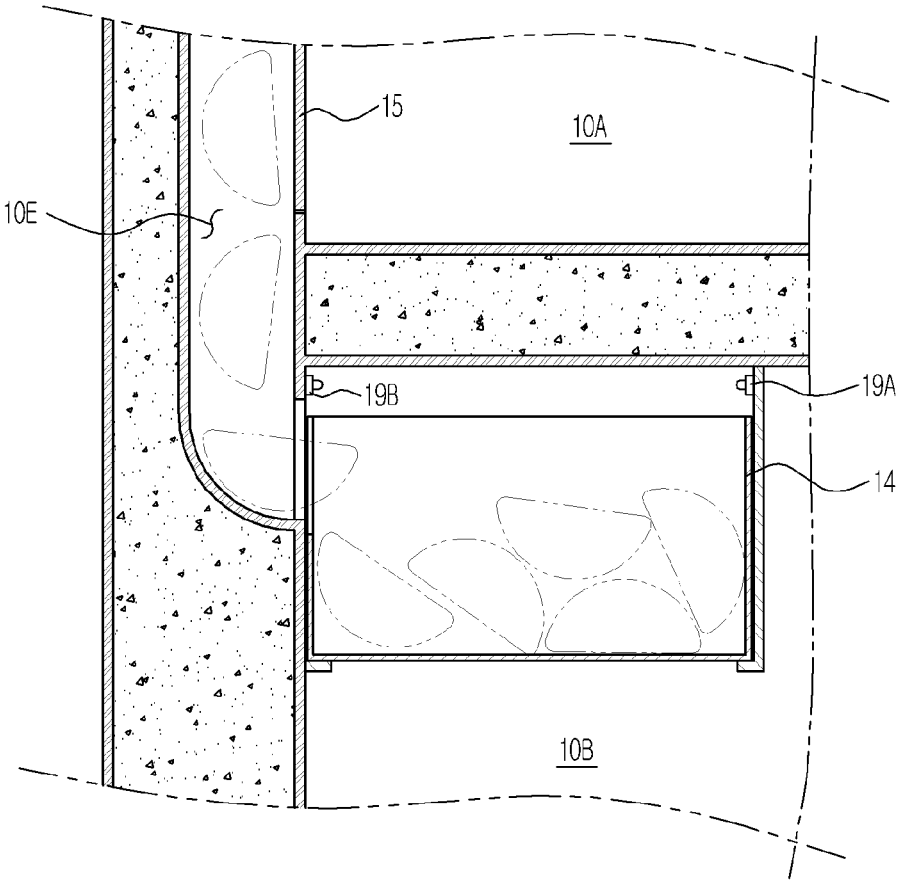
FIG. 5 is a cross-sectional view of a second storage container employed in a refrigerator according to one embodiment of the present invention.

The guide channel 10E, as shown in FIG. 3 to FIG. 5, is recessed into a side wall of the main body 10. An upper end of the guide channel 10E communicates with one side of a lower space of the ice making tray 31 while a lower end of the guide channel 10E communicates with the second storage container 14. As shown in FIG. 2, a channel cover 15 is installed on the side wall of the main body 10 in a detachable manner from the side wall so as to cover a portion of the guide channel 10E. Thus, if it is necessary to clean the guide channel 10E, the channel cover 15 is separated from the side wall of the main body 10 to expose the guide channel 10E and clean the same.

The second storage container 14 is formed in a drawer type and is installed in the freezing chamber 10B in a movable manner. At one side of the second storage container 14, a transfer opening 14*a* through which the ice is transferred to the container 14 is provided so as to communicate with the lower end of the guide channel 10E.

Ice made in the ice maker 30 first fills the first storage container 34 until the first storage container 34 is completely filled with the ice. Thereafter, the ice is guided to the second storage container 14 to fill the same.

To this end, a guide member 16 is disposed at the upper end of the guide channel 10E to enable transfer of the ice falling from the ice making tray 31 to a selected one of the first storage container 34 and the guide channel 10E.

The guide member 16 is installed at the side wall of the main body 10 in a rotatable manner and enables, by rotation thereof, such transfer of the ice falling from the ice making tray 31 to the selected one of the first storage container 34 and the guide channel 10E depending on a rotation angle thereof. A driving device 17 such as a motor, etc. is installed at the main body 10 to rotate the guide member 16.

For sensing ice amount, a first ice amount sensor 18A-18B is disposed in the ice making chamber 10C to sense ice amount of the first storage container 34, and a second ice amount sensor 19A-19B is disposed in the freezing chamber 10B to sense ice amount of the second storage container 14. In this embodiment, the first ice amount sensor 18A-18B includes a light-emitting unit 18A and a light-receiving unit 18B. The second ice amount sensor 19A-19B includes a light-emitting unit 19A and a light-receiving unit 19B.

Figure 6:
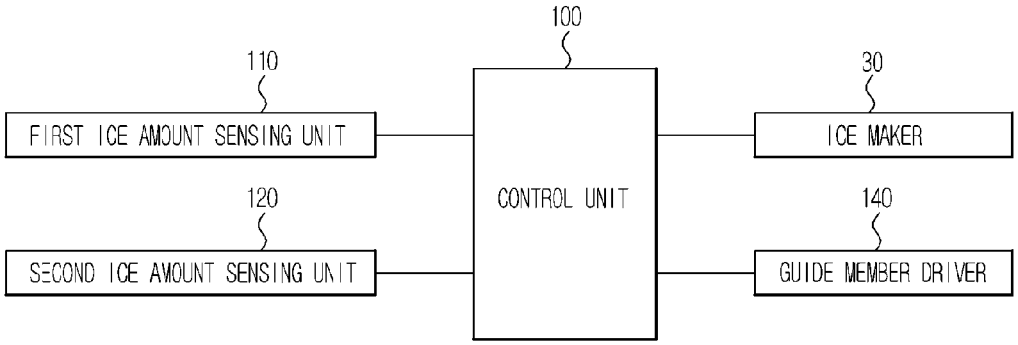
FIG. 6 is a block diagram for controlling a refrigerator according to one embodiment of the present invention.

As shown in FIG. 6, the refrigerator includes a control unit 100 to control the ice maker 30 and the guide member 16, a first ice amount sensing unit 110 including the first ice amount sensor 18A and 18B, a second ice amount sensing unit 120 including the second ice amount sensor 19A and 19B, and a guide member driver 140 including the driving device 17.

Figure 7:
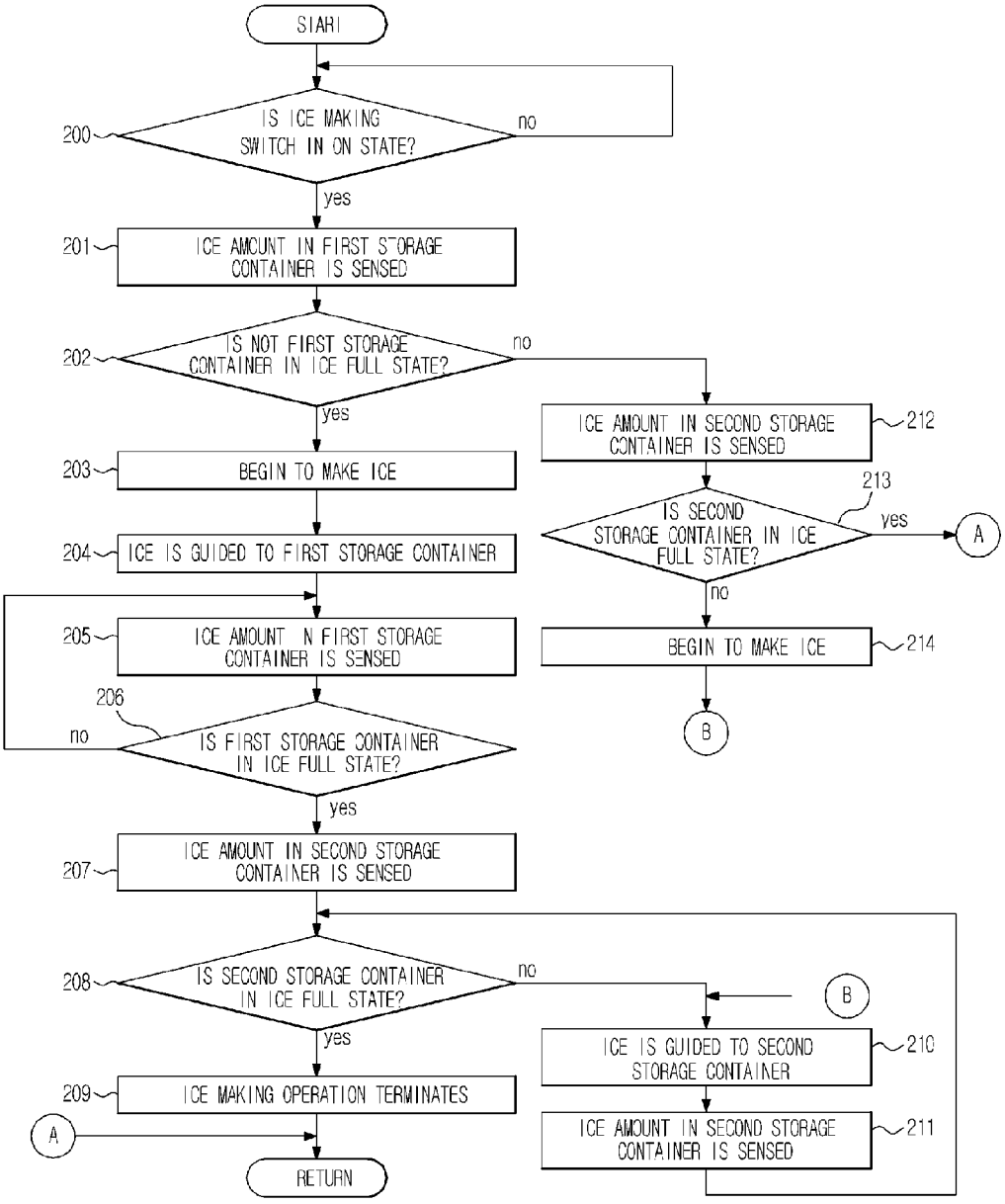
FIG. 7 is a flowchart of controlling a refrigerator according to one embodiment of the present invention.

Now, a method of controlling such a refrigerator will be described in detail with reference to FIG. 7.

As mentioned above, the refrigerator according to this embodiment the ice made in the ice maker 30 first fills the first storage container 34 until the first storage container 34 is completely filled with ice, and thereafter is guided to the second storage container 14 to fill the same.

For this purpose, it is first checked whether the ice making switch is in an ON state (200), and then if the ice making switch is in an ON state, the amount of ice in the first storage container 34 is sensed using the first ice amount sensor 18A and 18B (201).

It is determined whether the first storage container 34 is in an ice-full state (202). Upon a determination that the first storage container 34 is not in an ice-full state, the ice maker 30 begins to make ice (203). The ice made by the ice maker 30 is guided to the first storage container 34 by rotating the guide member 16 to a closed position using the driving device 17 (204).

The operation (204) of guiding the ice made by the ice maker 30 to the first storage container 34 continues until it is determined that the first storage container 34 is in an ice-full state. As the ice is being guided to the first storage container 34 the amount of ice contained within the first storage container is sensed again (205). It is determined again if the first storage container 34 is in a full state (206). Such operations (204, 205 and 206) are repeated until it is determined that the first storage container 34 is in an ice-full state.

Upon a determination that the first storage container 34 is in an ice-full state, the amount of ice in the second storage container 14 is sensed using the second ice amount sensor 19A and 19B (207). It is determined whether the second storage container 14 is in an ice-full state (208). Upon a determination that the second storage container 14 is in an ice-full state, the ice making operation terminates (209). Upon determining that the second storage container 14 is not in an ice-full state, the ice made by the ice maker 30 is guided to the guide channel 10E by rotating the guide member 16 to an open position using the driving device 17 (210). The ice guided to the channel 10E is transferred to the second storage container 14 through the transfer opening 14*a*. Once ice is guided to the second storage container 14, the amount of ice in the second storage container 14 is again sensed (211). It is again determined whether the second storage container 14 is in an ice-full state (208). Such operations (208, 210 and 211) are repeated until it is determined that the second storage container 14 is in an ice-full state and thus the ice making operation terminates (209).

At the operation (202) of determining whether the first storage container 34 is in an ice-full state and it is determined that the first storage container 34 is in an ice-full state, the amount of ice in the second storage container 14 is sensed using the second ice amount sensor 19A and 19B (212). Subsequently, it is determined whether the second storage container 14 is in an ice-full state (213). Upon determining that the second storage container 14 is not in an ice-full state, the ice maker 30 begins to make ice (214).

After the ice making operation (214), ice made by the ice maker 30 is guided to the guide channel 10E by rotating the guide member 16 using the driving device 17 (210). Once ice is guided to the second storage container 14, the amount of ice in the second storage container 14 is again sensed (211) and then it is again determined whether the second storage container 14 is in an ice-full state (208). Such operations (208, 210 and 211) are repeated until it is determined that the second storage container 14 is in an ice-full state.

Using the above-mentioned method, the first storage container 34 is first filled with ice and, thereafter, the second storage container 14 is filled with ice.

Although a few embodiments of the present invention have been shown and described, it would be appreciated by those skilled in the art that changes may be made in these embodiments without departing from the principles and spirit of the invention, the scope of which is defined in the claims and their equivalents.

What is claimed is:

1. A refrigerator comprising:

a main body including a refrigerating chamber at an upper section of the main body, a freezing chamber at a lower section of the main body and an ice making chamber at the refrigerating chamber;

an ice making tray in an upper space of the ice making chamber;

a first storage container in a lower space of the ice making chamber to store therein ice from the ice making tray; and a second storage container in the freezing chamber to store therein ice from the ice making tray, wherein the main body comprises a guide channel formed in a side wall of the main body to guide the ice, and a channel cover removably installed at the side wall of the main body to cover the guide channel, and wherein, when the first storage container reaches an ice-full state, the guide channel by-passes the ice around the refrigerating chamber by guiding the ice from the ice making tray directly to the second storage container in the freezing chamber.

2. The refrigerator according to claim 1, further comprising:

a guide member to selectively guide ice from the ice making tray to either the guide channel or the first storage container; and a driving device to rotate the guide member.

3. The refrigerator according to claim 2, wherein the guide member is rotatably installed at the side wall of the main body to guide ice to either the guide channel or the first storage container depending on a rotation angle of the guide member.

4. The refrigerator according to claim 1, further comprising:

a refrigerating chamber door to open or close the refrigerating chamber; and a dispenser in the refrigerating chamber door to discharge the ice.

5. The refrigerator according to claim 4, further comprising a conveying auger in the first storage container to enable ice in the first storage container to be discharged through the dispenser.

6. A method of controlling a refrigerator including a refrigerating chamber at an upper section of a main body, a freezing chamber at a lower section of the main body and an ice making chamber at the refrigerating chamber comprising: making ice in the ice making chamber; guiding the ice to a first storage container in a lower space of the ice making chamber or guiding ice via a channel directly to a second storage container in the freezing chamber while by-passing the refrigerating chamber; and removably installing a cover for the channel at the refrigerator chamber, wherein the ice is first guided to the first storage container until the first storage container reaches an ice-full state, and then the ice is guided to the second storage container until the second storage container reaches an ice-full state.

7. The method according to claim 6, comprising:

determining whether the first storage container is in the ice-full state;

upon determining that the first storage container is not in the ice-full state, making ice using the ice maker; and guiding the ice made by the ice maker to the first storage container until the first storage container reaches the ice-full state.

8. The method according to claim 7, further comprising:

upon determining that the first storage container is in the ice-full state, determining whether the second storage container is in the ice-full state;

upon determining that the second storage container is not in the ice-full state, making ice using the ice maker; and guiding the ice made by the ice maker to the second storage container until the second storage container reaches the ice-full state.

9. The method according to claim 8, further comprising, after the second storage container reaches the ice-full state, terminating making of the ice using the ice maker.

10. The method according to claim 7, further comprising:

determining whether the first storage container is in the ice-full state;

upon determining that the first storage container is in the ice-full state, determining whether the second storage container is in the ice-full state;

upon determining that the second storage container is not in the ice-full state, making ice using the ice maker; and guiding the ice made by the ice maker directly to the second storage container while by-passing the refrigerating chamber until the second storage container reaches the ice-full state.

11. A refrigerator comprising:

a freezing chamber;

an ice making chamber disposed at an upper part of the freezing chamber; and a refrigerating chamber between the ice making chamber and the freezing chamber; and an ice maker in the ice making chamber supplying ice to a first storage unit and to a second storage unit;

wherein the first storage unit is located in the ice making chamber and the second storage unit is located in the freezing chamber, wherein the ice is supplied to the second storage unit by a passage in a side of the refrigerating and freezing chambers, wherein a guide member guides the ice from the ice maker into the passage without the ice entering the first storage unit, and into the second storage unit while by-passing the refrigerating chamber, wherein a channel cover is removably installed at the refrigerating chamber, and wherein the guide member guides the ice from the ice maker directly to the second storage unit when the first storage unit reaches an ice-full state.

* * * * *